US011112757B2

(12) United States Patent
Marolda

(10) Patent No.: US 11,112,757 B2
(45) Date of Patent: Sep. 7, 2021

(54) SYSTEM FOR WINDING A TIMEPIECE

(71) Applicant: ROLEX SA, Geneva (CH)

(72) Inventor: Bruno Marolda, Boussens (CH)

(73) Assignee: ROLEX SA, Geneva (CH)

( * ) Notice: Subject to any disclaimer, the term of this patent is extended or adjusted under 35 U.S.C. 154(b) by 418 days.

(21) Appl. No.: 15/894,136

(22) Filed: Feb. 12, 2018

(65) Prior Publication Data

US 2018/0231935 A1 Aug. 16, 2018

(30) Foreign Application Priority Data

Feb. 13, 2017 (EP) ..... 17155907

(51) Int. Cl.

| | |
|---|---|
| ***G04B 11/04*** | (2006.01) |
| ***G04B 5/02*** | (2006.01) |
| ***G04B 5/00*** | (2006.01) |
| ***G04B 11/00*** | (2006.01) |

(52) U.S. Cl.

CPC ..... *G04B 11/04* (2013.01); *G04B 5/00* (2013.01); *G04B 5/02* (2013.01); *G04B 11/006* (2013.01)

(58) Field of Classification Search

CPC ..... G04B 5/00; G04B 11/00; G04B 11/04; G04B 11/006; G04B 5/02

See application file for complete search history.

(56) References Cited

U.S. PATENT DOCUMENTS

| | | | | |
|---|---|---|---|---|
| 2,707,371 | A | 5/1955 | Kocher | |
| 2008/0192585 | A1 | 8/2008 | Corthesy et al. | |
| 2010/0226216 | A1 | 9/2010 | Courvoisier et al. | |
| 2016/0363908 | A1 * | 12/2016 | Kirchhof ..... | G04B 5/14 |

FOREIGN PATENT DOCUMENTS

| | | |
|---|---|---|
| EP | 1 708 050 A1 | 10/2006 |
| EP | 2 226 687 A1 | 9/2010 |
| EP | 2 367 080 A1 | 9/2011 |
| EP | 2 503 408 A1 | 9/2012 |

OTHER PUBLICATIONS

C.-A. Reymondin et al., "Horology Theory", Fed. des Ecoles Techniques, Lausanne, Switzerland, 1998, pp. 183-184 (with English machine translation; cited in the specification; 8 pages).

European Search Report and Written Opinion dated Aug. 3, 2017 issued in counterpart application No. EP17155907; w/ English machine translation (18 pages).

* cited by examiner

*Primary Examiner* — Edwin A. Leon
*Assistant Examiner* — Jason M Collins
(74) *Attorney, Agent, or Firm* — Westerman, Hattori, Daniels & Adrian, LLP

(57) ABSTRACT

System (10) including (i) a pawl device (110) for a first wheel (6) of a first part (301) of a drivetrain (300) for winding a mainspring (7); (ii) a clutch device (120) for engaging a second part (302) of a drivetrain (300) for winding the mainsprin (7) with the first part (301) of the drivetrain (300) for winding the mainspring (7); and (iii) a coupling device (130) for coupling the pawl device and the clutch device, particularly a device (130) for coupling the states of operation of the pawl device and of the clutch device.

23 Claims, 5 Drawing Sheets

SYSTEM FOR WINDING A TIMEPIECE

This application claims priority of European patent application No. EP17155907.3 filed Feb. 13, 2017, which is hereby incorporated herein in its entirety.

The invention relates to a horology system. The invention also relates to a horology movement comprising such a system. The invention also relates to a timepiece comprising such a system or such a movement. The invention also relates to a method of operation of such a system, of such a movement or of such a timepiece. The invention also relates to a winding drivetrain for a mainspring. The invention also relates to a horology movement comprising such a drivetrain. The invention also relates to a timepiece comprising such a drivetrain or such a movement.

Mainsprings in manually wound or automatically wound timepieces are usually kept under tension by a pawl which is designed to collaborate with a ratchet mounted squarely on the barrel arbour or directly with a barrel drum in the case of a movement provided with at least two barrels. More particularly, the pawl immobilizes the ratchet in the direction of uncoiling of the mainspring, and disengages when the manual or automatic winding device is actuated.

When a conventional manually wound movement is dismantled, the watchmaker has the option of uncoiling the mainspring in a single operation by retracting the pawl from the barrel drum or ratchet toothset. In the case of a movement with automatic winding, particularly in the case of a movement with bi-directional automatic winding, such an operation cannot be made possible because of the very design of the automatic winding device. Specifically, by their construction, automatic winding devices immobilize the ratchet in the direction of the uncoiling of the spring which means that retracting the pawl from the drum or ratchet toothset is not enough to allow the mainspring to uncoil.

Such an automatic winding device may for example comprise a friction wheel, as mentioned in the work "Théorie d'horlogerie [Horology Theory]" (Reymondin, Monnier, Jeanneret, Pelaratti, Fédération des écoles techniques, 1998, chapter 8.3.6; page 183). This wheel for example comprises a wheel and a pinion which are joined together unidirectionally by means of a three-arm friction spring fixed to the pinion. The pinion is in mesh with a barrel ratchet, while the wheel is in mesh with an automatic winding drivetrain. During operation of the automatic winding device, the wheel and the pinion are kinematically linked by means of the spring the three arms of which become lodged in holes made in the plate of the wheel. During manual winding, the kinematic connection between the ratchet and the drivetrain of the automatic winding device is broken by the spring the three arms of which become dislodged from the holes made in the plate of the wheel.

Such a construction advantageously allows the manual winding drivetrain to be disengaged from the automatic winding drivetrain. Nevertheless, it does not allow a break in the drivetrain established between the ratchet and the automatic winding device in the direction of rotation of the ratchet that corresponds to the uncoiling of the mainspring, which means that retracting the pawl from the toothset of the ratchet is not enough to allow the mainspring to uncoil, because this mainspring is blocked by the pawl that forms part of the winding device. Moreover, such a solution is suboptimal because of the resistive torque induced by the friction wheel during manual winding. This solution may also be subject to wear, with risks of unwanted damage to the friction wheel in the event of intensive manual winding.

Document U.S. Pat. No. 2,707,371 discloses another form of disengagement device designed to break the connection between an automatic winding device and a barrel. In this document, the disengagement device takes the form of a horizontal disengagement device. This system notably comprises a pinion which is in mesh with a ratchet driving wheel designed to move within a curved oblong cutout. During manual winding, the ratchet is turned in the clockwise direction under the effect of a drivetrain. In this configuration, the toothset of the wheel is disengaged from the toothset of the ratchet because of the resultant of the forces applied to the wheel. Once manual winding is over, the wheel is returned towards the ratchet under the effect of a wire spring. When the automatic winding device is activated, the toothset of the wheel remains engaged with the toothset of the ratchet because of the resultant of the forces applied to the wheel. In this configuration, the drivetrain for manual winding is broken by a second horizontal clutch device.

Such a construction advantageously allows the manual winding drivetrain to be disengaged from the automatic winding drivetrain. However, during manual winding, the wheel is susceptible to "oscillate" within the cutout under the effect of the spring, which means that the toothset of the wheel may with a high or lower frequency knock against the toothset of the ratchet depending on the speed of the manual winding. Such a construction may therefore be subject to premature wear. Furthermore, the device divulged has no pawl allowing the mainspring to be kept under tension independently of the automatic winding device. A timepiece incorporating such a device thus cannot operate independently of its automatic winding device. There is also the problem of the dismantling of the automatic winder which exposes the watchmaker to the problem of unwanted uncontrolled uncoiling of the mainspring. Therefore such a solution is not optimal.

Document EP2226687 discloses another form of disengagement device desired to break the connection between an automatic winding device and a barrel. In that document, the disengagement device takes the form of a vertical disengagement device. This disengagement device has the advantage of allowing the watchmaker to uncoil, using a sliding spindle, the mainspring without having to dismantle the automatic winding device which here takes the form of an automatic winding device with two-directional winding provided with reversing wheels, the configuration of which allows the mainspring to be kept under tension. This disengagement device also has the advantage of interrupting the manual winding drivetrain and the automatic winding drivetrain during manual winding, so that the reversing wheels are not called into operation in this configuration. However, during manual winding, the toothsets belonging to the clutch device constantly ratchet against a spring, which means that these toothsets may be subject to intensive wear, notably in the case of sustained manual winding.

Furthermore, just like in the device disclosed in document U.S. Pat. No. 2,707,371, this device has absolutely no pawl allowing the mainspring to be kept under tension independently of the automatic winding device. A timepiece incorporating such a device cannot therefore operate independently of its automatic winding device. There is also the problem of the dismantling of the automatic winder which exposes the watchmaker to the problems of uncontrolled unwanted uncoiling of the mainspring. Furthermore, assuming that a pawl is provided for keeping the mainspring under tension to supplement the aforementioned device, the watchmaker will need to act simultaneously on two independent and spaced-apart devices in order to uncoil this spring; he would need on the one hand to act on the sliding spindle and, on the other hand, on the pawl itself. It is therefore found that this solution is not satisfactory either, particularly in terms of serviceability.

It is an object of the invention to provide a system that makes it possible to overcome the aforementioned disadvantages and to improve the systems known from the prior art. In particular, the invention proposes a system allowing a movement to operate independently of its automatic winding device, while at the same time avoiding the phenomena of toothset wear and allowing controlled uncoiling of the mainspring by a watchmaker.

According to a first aspect of the invention, a system is defined by point 1 below.

1. System comprising:

a pawl device for a first wheel of a first part of a drivetrain for winding a mainspring;

a clutch device for engaging a second part of a drivetrain for winding the mainspring with the first part of the drivetrain for winding the mainspring; and a coupling device for coupling the pawl device and the clutch device, particularly a device for coupling the states of operation of the pawl device and of the clutch device.

Various embodiments of the system according to the first aspect of the invention are defined by points 2 to 8 below.

2. System according to the preceding point, wherein the coupling device is arranged in such a way as to keep the clutch device in the engaged state when the pawl device is activated and/or in such a way as to allow the clutch device an engaged state and a disengaged state when the pawl device is deactivated.

3. System according to one of the preceding points, wherein the pawl device comprises a pawl equipped with at least one tooth and a return spring for returning the pawl to a rest position corresponding to the activated state of the pawl device in which position the at least one tooth interferes with a toothset of the first wheel.

4. System according to the preceding point, wherein, in the rest position, the pawl is in contact with a banking.

5. System according to one of the preceding points, wherein the clutch device is a horizontal clutch device and/or a clutch device comprising a rocker lever equipped with an intermediate wheel intended to:

mesh simultaneously with the first wheel and with the second wheel in a first position of the rocker lever defining an engaged state of the clutch device; and not mesh with the first wheel and/or mesh only with the second wheel in a second position of the rocker lever defining a disengaged state of the clutch device.

6. System according to one of the preceding points, wherein the first wheel is a ratchet, notably a barrel ratchet.

7. System according to one of the preceding points, wherein the coupling device comprises a pawl device return spring portion collaborating by contact with a portion of the clutch device, notably a clutch device rocker lever portion.

8. System according to one of points 1 to 6, wherein the coupling device comprises an arm of the pawl device, a portion of the arm collaborating by contact with a portion of the clutch device, notably a rocker lever portion of the clutch device.

According to the first aspect of the invention, a movement is defined by point 9 below.

9. Automatic watch movement comprising a system according to one of the preceding points.

Various embodiments of the movement according to the first aspect of the invention are defined by points 10 and 11 below.

10. Watch movement according to the preceding point, wherein it comprises an automatic winding device equipped with reversing wheels notably an automatic winding module equipped with reversing wheels.

11. Watch movement according to point 9 or 10, in which the pawl device can be actuated by the watchmaker, whereas the automatic winding module is assembled on the movement.

According to the first aspect of the invention, a method of operation is defined by point 12 below.

12. Method of operation of a system according to one of points 1 to 8 or of a movement according to one of points 9 to 11 or of a timepiece according to the preceding point, the method comprising the following steps during manual winding:

retraction of the pawl under the effect of the rotation of the first wheel, release of the clutch device under the effect of the coupling device, and disengagement of the clutch device under the effect of the rotation of the first wheel.

Various embodiments of the method of operation according to the first aspect of the invention are defined by points 13 and 14 below.

13. Method of operation according to the preceding point, the method comprising the following steps during automatic winding:

retraction of the pawl under the effect of the rotation of the first wheel, release of the clutch device under the effect of the coupling device, and engagement of the clutch device under the effect of the rotation of a second wheel of the second drivetrain part for winding the mainspring.

14. Method of operation according to point 12 or 13, the method comprising the following step:

in the absence of winding, actuating the coupling device on the clutch device so as to return the clutch device to an engaged state, notably an engaged state corresponding to the activated state of the pawl device.

According to the first aspect of the invention, a timepiece is defined by points 15 to 18 below.

15. Winding drivetrain for mainspring, comprising:

a first drivetrain part and a second drivetrain part, the second drivetrain part comprising reversing wheels, and a horizontal clutch device for connecting the first and second drivetrain parts.

16. Automatic watch movement comprising a winding drivetrain according to point 15.

17. Watch movement according to the preceding point, wherein the movement comprises a pawl device, the pawl device being arranged in such a way as to be able to be actuated while the automatic winding device is assembled on the rest of the movement.

18. Timepiece, notably wristwatch, comprising a movement according to one of points 9 to 11 or 16 or 17 or a drivetrain according to point 15 or a system according to one of points 1 to 8.

A second aspect of the invention is defined by the following definitions.

a) Mainspring winding drivetrain comprising:

a first drivetrain part and a second drivetrain part, the second drivetrain part comprising reversing wheels, and a horizontal clutch device for connecting the first and second drivetrain parts.

b) Winding drivetrain according to definition a), wherein the reversing wheels are arranged in series or in parallel.

c) Winding drivetrain according to definition b), wherein the reversing wheels comprise levers collaborating with asymmetrically toothed wheels.

d) Winding drivetrain according to one of definitions a) to c), wherein the second drivetrain part is incorporated into an automatic winding device, notably an automatic winding module, or wherein the second drivetrain part comprises an automatic winding device, notably an automatic winding module or wherein the second drivetrain part forms part of an automatic winding device, notably forms part of an automatic winding module.

e) Automatic watch movement comprising a winding drivetrain according to one of definitions a) to d).

f) Watch movement according to the preceding definition, wherein the movement comprises a pawl device, the pawl device being arranged in such a way as to be able to be actuated when the automatic winding device is assembled on the rest of the movement.

g) Timepiece, notably wristwatch, comprising a movement according to one of definitions e) and f) or a drivetrain according to one of definitions a) to d).

The attached figures depict by way of examples two embodiments of a timepiece according to the invention.

Figure 8:
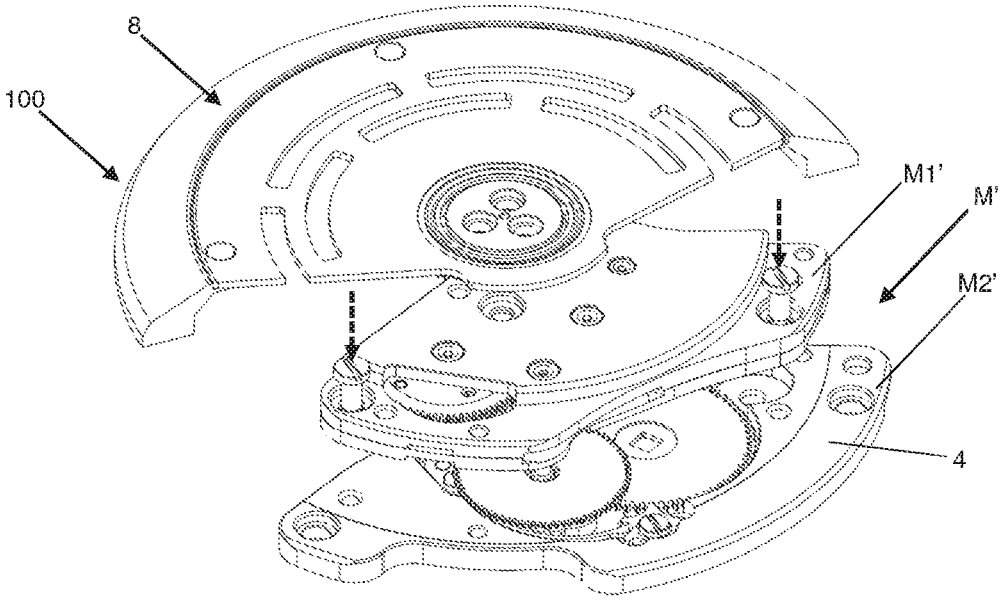
FIGS. 8 and 9 are views of one embodiment of an automatic winding module preferably used in the context of the invention.

A first embodiment of a timepiece 200 is described hereinafter with reference to FIGS. 1 to 6. The timepiece is, for example, a watch, particularly a wristwatch. The timepiece comprises a movement 100. The movement is preferably a mechanical and automatic movement. The movement comprises a frame 4, a mainspring 7, a geartrain and an automatic winder or automatic winding device. The automatic winding device may be an automatic winding module M' as depicted in FIG. 8. What is meant throughout this document by an "automatic winder" or "automatic winding device" is a drivetrain 300, 300' for automatically winding the movement or part of a drivetrain for automatically winding the mainspring 7, 7' of the movement. The part of the drivetrain comprises at least one oscillating mass 8 the mechanical energy of which is used to wind the mainspring.

Figure 9:
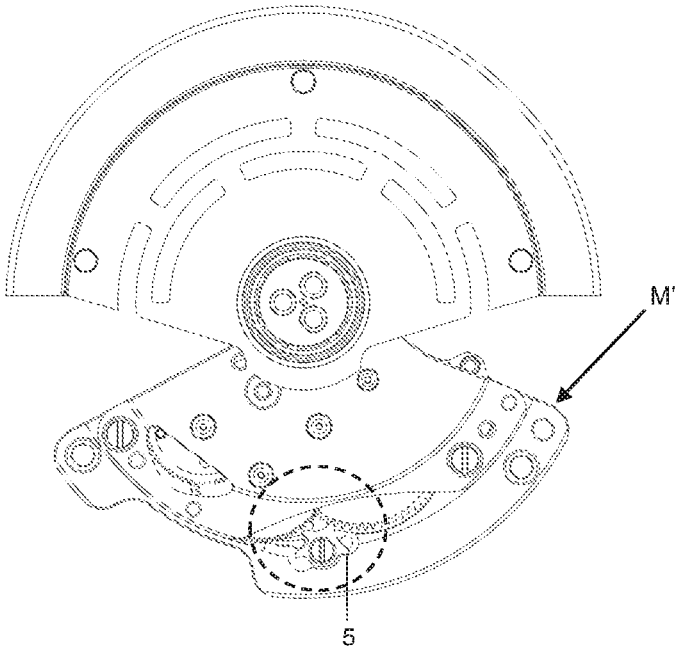

For preference, the automatic winder comprises reversing wheels 11, 12. The automatic winder is therefore preferably two-directional, which means to say that a ratchet 6 associated with the mainspring 7 is driven in a single and same direction of coiling of the spring whatever the direction of rotation of the oscillating mass 8. The two reversing wheels 11, 12 make it possible on the one hand for the ratchet to be driven by a transmission of movement from the oscillating mass 8 in the direction of the coiling of a mainspring and, on the other hand, to immobilize the ratchet in the direction of the uncoiling of the mainspring under the effect of the oscillating mass 8. Specifically, the drivetrain for automatic winding of the movement is irreversible in this embodiment. Thus, the automatic winder is preferably designed to immobilize a ratchet or a wheel in a direction of uncoiling of the mainspring. In this particular construction, the automatic winder may be an automatic winding module M'. The module is, for example, designed to be fixed to a barrel bridge 4 of the movement as depicted in FIGS. 8 and 9. The module for example comprises two blanks M1', M2' which pivot different geartrains of the automatic winder and the oscillating mass 8. Thus, the drivetrain for automatic winding may potentially be substituted for a ratchet pawl or a drum pawl.

Advantageously, the reversing wheels 11, 12 are mounted in series. Advantageously also, the reversing wheels 11, 12 are connected to a pinion 1, notably by means of a wheel 13 which is secured to and coaxial with the latter.

The drivetrain 300 for automatic winding or automatic winding drivetrain extends from the oscillating mass 8 to the mainspring 7, the oscillating mass and the mainspring being included in the drivetrain.

A drivetrain for manual winding or manual winding drivetrain (not depicted) extends from an element that can be manipulated directly by the user, such as a crown, to the mainspring 7, the element that can be manipulated and the mainspring being included in the drivetrain.

The movement comprises a first embodiment of a system 10 comprising:

a pawl device 110 for a first wheel 6 of a first part 301 of a drivetrain 300 for winding the mainspring 7;

a clutch device 120 for engaging a second part 302 of a drivetrain 300 for winding the mainspring 7 with the first part 301 of the drivetrain 300 for winding the mainspring 7;

a coupling device 130 for coupling the pawl device and the clutch device, particularly a device 130 for coupling the states of operation of the pawl device and of the clutch device.

Figure 10:
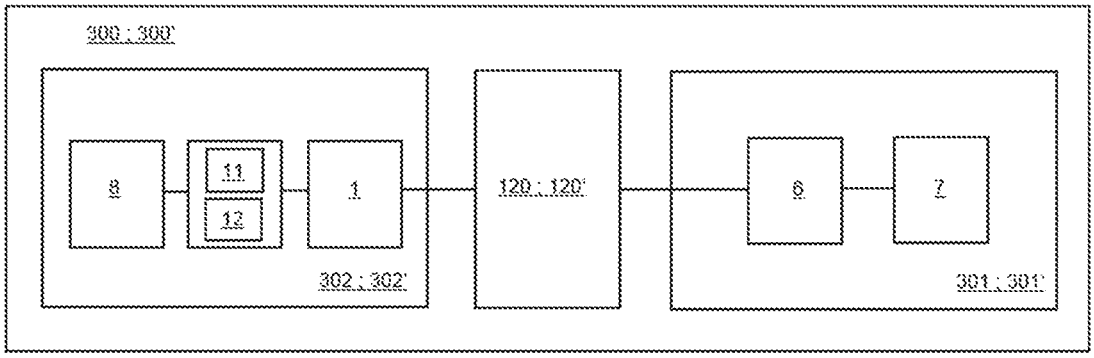
FIG. 10 is a schematic view of one embodiment of an automatic winding drivetrain according to the invention.

Thus, as depicted in FIG. 10, the drivetrain 300, 300' for winding the mainspring 7 comprises:

a first drivetrain part 301; 301' and a second drivetrain part 302; 302', the second drivetrain part comprising the reversing wheels 11, 12, and a horizontal clutch device 120, 120' for connecting the first and second drivetrain parts.

The reversing wheels are preferably arranged in series. Alternatively they may be arranged in parallel.

The reversing wheels comprise levers 111, 112 and 121, 122 respectively collaborating with assymetrically toothed wheels 113, 123.

The clutch device 120 makes it possible to distinguish a first part 301 of drivetrain 300 for winding, notably automatically winding, the mainspring 7, from a second part 302 of drivetrain 300 for winding, notably automatically winding, the mainspring 7. The clutch device makes it possible, in a first state referred to as "engaged", to connect or secure, notably kinematically connect or secure, these first and second parts to constitute the winding drivetrain or, in a second state referred to as "disengaged" to disconnect, notably kinematically disconnect, these first and second parts.

The first drivetrain part extends from the mainspring 7 to the clutch device.

The second drivetrain part extends from the oscillating mass 8 to the clutch device.

Figure 4:
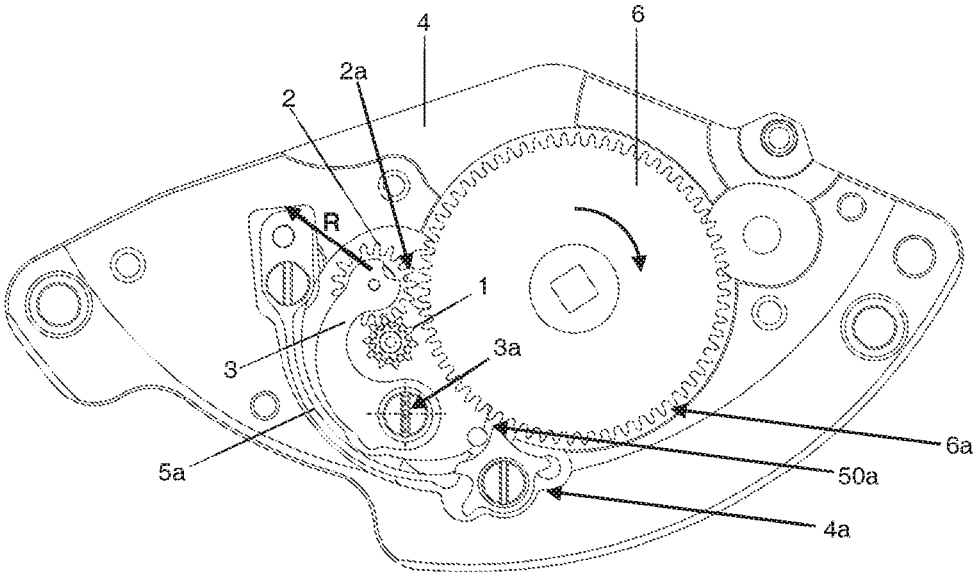
FIG. 4 is a view of the first embodiment of the system in a first configuration.
Figure 5:
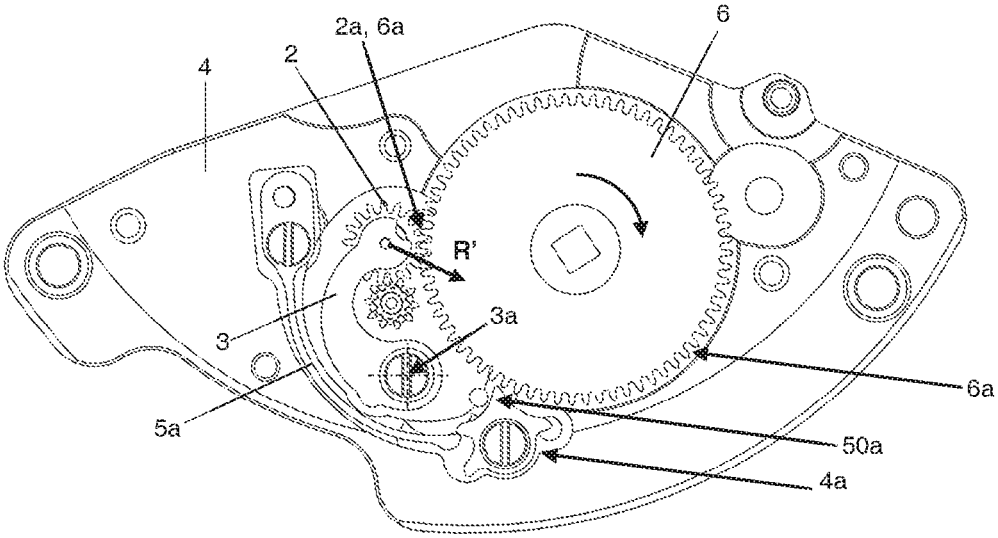
FIGS. 5 and 6 are views of the first embodiment of the system in a second configuration.
Figure 6:
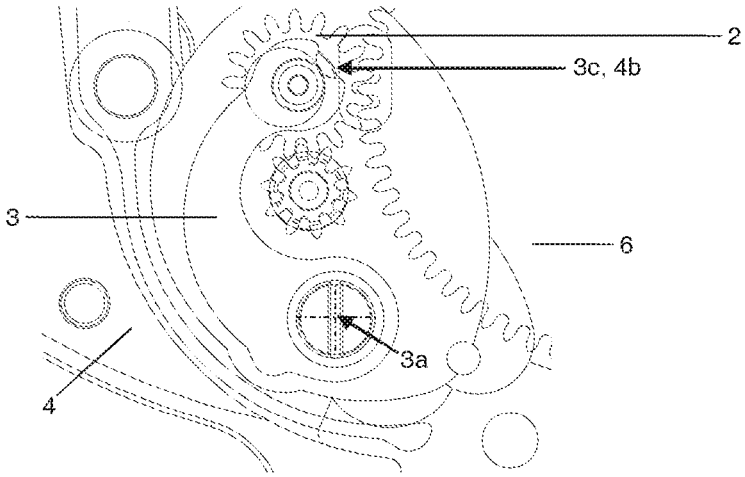

For preference, the clutch device is a horizontal clutch device and/or a clutch device comprising a rocker lever 3 equipped with an intermediate wheel 2 intended to:

- mesh simultaneously with a first element of the first winding drivetrain part, notably the first wheel 6 and with a second element of the second winding drivetrain part, notably the second wheel or pinion 1, in a first position of the rocker lever defining the first engaged state of the clutch device, as depicted in FIG. 5; and
- not mesh with the first element of the first winding drivetrain part and/or mesh only with the second element of the second winding drivetrain part, in a second position of the rocker lever defining the second disengaged state of the clutch device, as depicted in FIG. 4.

The intermediate wheel 2 is preferably pivoted on the rocker lever 3. The rocker lever itself is pivot mounted about a spindle 3*a* on a frame or movement blank, notably on a barrel bridge 4. Alternatively, the rocker lever could be pivoted on the pawl or vice versa. Alternatively, the intermediate wheel 2 may be guided within an oblong cutout in the frame of the movement the extent of which corresponds substantially to the angular travel of the rocker lever 3.

Thus, the intermediate wheel 2 is moved in the plane of the frame of the movement according to the state of the clutch device.

The rocker lever 3 collaborates with a pawl spring 5*a*. The spring is preferably fixed to a movement blank and designed to act on the clutch device, particularly on the rocker lever, to return it to a rest position or engaged state depicted in FIG. 1. In this configuration, a shaping 3*c* of the rocker lever forming a banking (depicted in FIG. 6) is in contact with a banking 4*b* (depicted in FIG. 6) provided on the frame of the movement, particularly on a blank, notably on the barrel bridge. The banking 3*c* may, for example, be a wall of a pin on which the intermediate wheel 2 pivots. The banking 4*b* may for example be a wall of a bore. The banking 3*c* and the banking 4*b* are designed to guarantee the most precise possible centre distance between the intermediate wheel 2 and the first wheel 6 thus ensuring correct meshing of the intermediate wheel with the first wheel.

The return action is produced or not according to the state of the pawl device as described in greater detail later on. This pawl spring also forms part of the coupling device which is described in greater detail later on.

For preference, the intermediate wheel 2 has a greater diameter than the pinion 1.

For preference, the pawl device 110 allows the first wheel 6 of the first part of the drivetrain for winding the mainspring 7 to be immobilized. The first wheel is advantageously a barrel ratchet 6.

Figure 1:
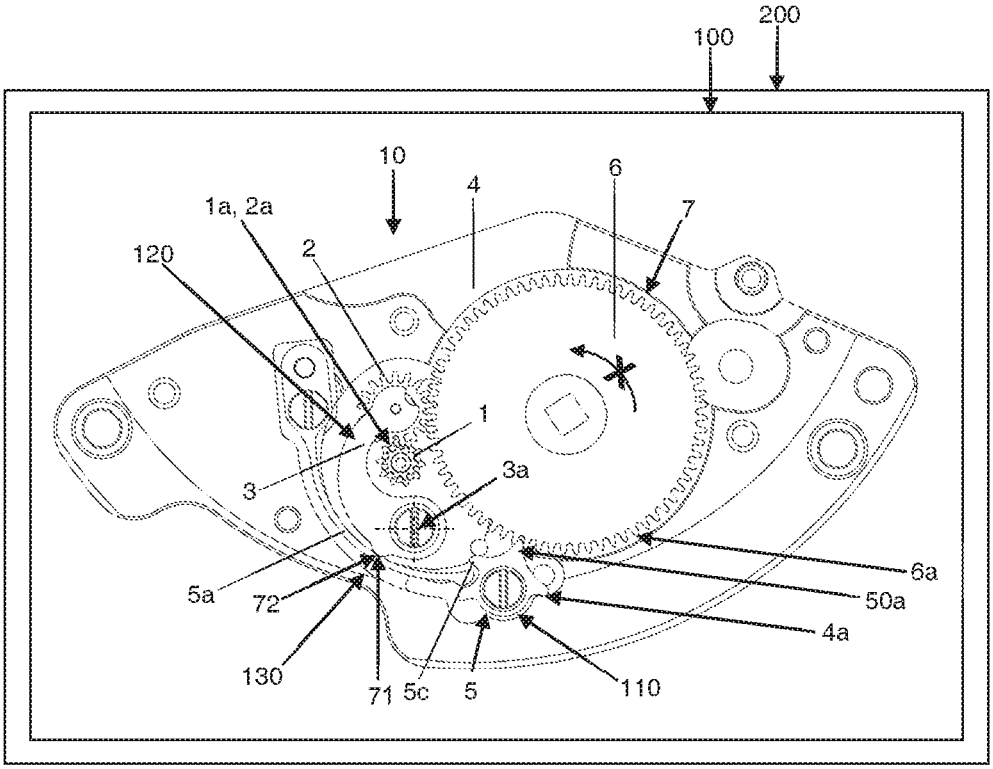
FIG. 1 is a schematic view of a first embodiment of a timepiece according to the invention comprising a first embodiment of a system.
Figure 2:
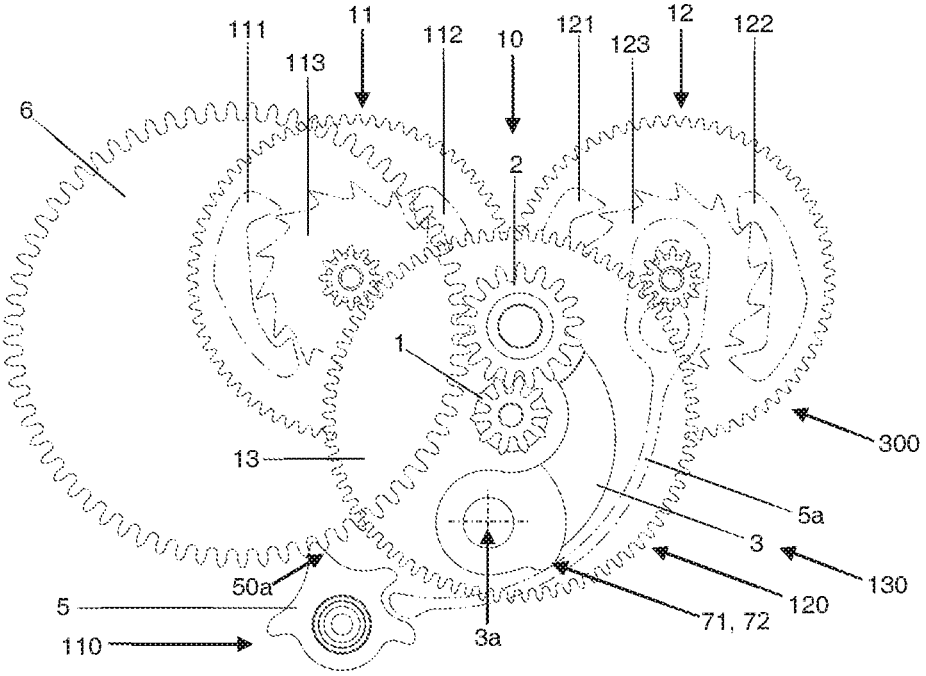
FIGS. 2 and 3 are views of the first embodiment of the system, from above and from beneath.
Figure 3:
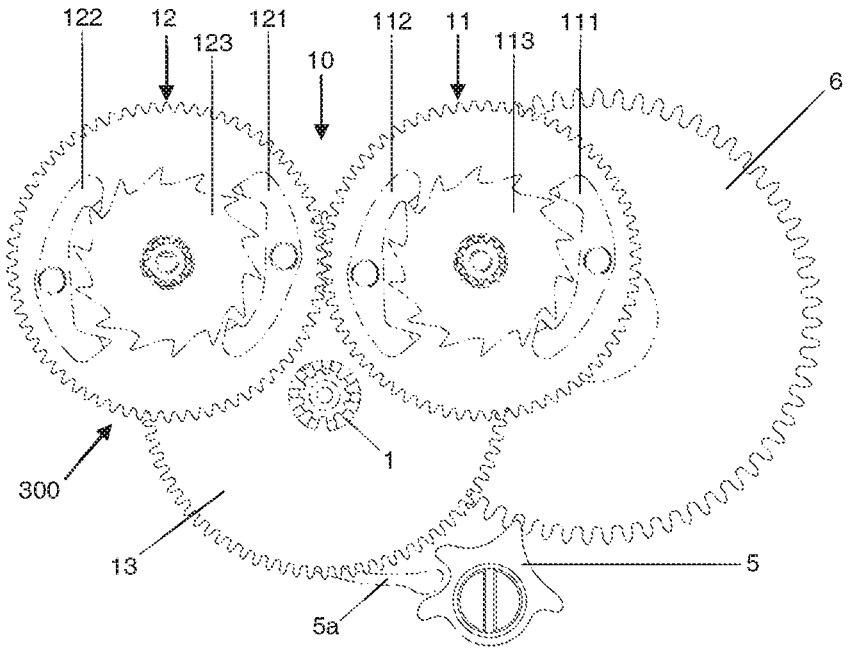

The pawl device comprises a pawl 5 equipped with a tooth or a beak 50*a* and a return spring 5*a* for returning the pawl towards a rest position (depicted in FIG. 1) corresponding to the activated state of the pawl device and in which the tooth interferes with a toothset 6*a* of the first wheel 6. In this activated state the pawl prevents the first wheel 6 from rotating in one direction of rotation, notably the anticlockwise direction as depicted in FIG. 1, corresponding to the uncoiling of the mainspring 7. In the rest position, the pawl is in contact with a banking 4*a* provided on the frame of the movement, notably on the barrel bridge. The pawl and the spring are arranged in such a way that the pawl is returned to its rest position by the spring 5*a* when the pawl is in a disengaged state, then the pawl is returned (alternatively or in addition) toward its rest position by the action of the mainspring via the first wheel 6 when the pawl is interfering with the toothset 6*a*. Specifically, in the rest position, the spring 5*a* can no longer act on the pawl as depicted in FIG. 1.

The pawl is for example a lever 5*c* pivoting on a barrel bridge. The lever comprises a first arm ending in at least one tooth able to interfere with the toothset of the first wheel. The lever comprises a second arm arranged in such a way as to collaborate with the banking 4*a* to define the rest position of the pawl. The lever comprises a third arm arranged in such a way as to collaborate in bearing on the spring 5*a* when the pawl device is notably deactivated. Finally, the lever may comprise a fourth arm designed to be something that a watchmaker can manipulate, notably using a tool.

When the first wheel 6 is driven in a direction of rotation opposite to that depicted in FIG. 1, corresponding to the coiling of the mainspring 7, the pawl is positioned in a second position depicted in FIGS. 4 and 5. This position is a unclicked or disengaged position corresponding to a deactivated state of the pawl.

The coupling device allows the states of the pawl device and of the clutch device to be coupled or connected logically.

The coupling device 130 is designed in such a way as to maintain an engaged state of the clutch device 120 when the pawl device is activated. Thus, when the pawl is in an activated state as depicted in FIG. 1, the coupling device forces the clutch device to be in the engaged state.

The coupling device 130 is additionally arranged in such a way as to allow an engaged state and a disengaged state of the clutch device 120 when the pawl device is deactivated. Thus, when the pawl is in the deactivated state as depicted in FIGS. 4 and 5, the coupling device does not force the clutch device to be in the engaged state or in the disengaged state. The clutch device can be in either one of the engaged and disengaged states depending on other considerations or factors. In particular, in this configuration, the state of the clutch device is advantageously dictated or determined by the states of the first and second parts of the automatic winding drivetrain. Driving of the first part of the automatic winding drivetrain (due to manual winding, and therefore without driving of the second part of the automatic winding drivetrain) causes disengagement of the clutch device. Conversely, driving of the second part of the automatic winding drivetrain (due to movement of the oscillating mass) causes the clutch device to engage.

In the first embodiment, the coupling device 130 comprises a pawl device return spring 5*a* portion 71 collaborating by contact with a portion 72 of the clutch device, notably a clutch device rocker lever 3 portion 72. The clutch device and the spring are arranged in such a way that the portions are in contact when the pawl is activated and that this contact determines the engaged state of the clutch device, particularly the position of the rocker lever 3 corresponding to the engaged state of the clutch device.

A second embodiment of a timepiece 200' is described hereinafter with reference to FIG. 7. The timepiece is, for example, a watch, particularly a wristwatch. The timepiece comprises a movement 100'. The movement is a mechanical and automatic movement. The movement comprises a frame, a mainspring 7, a geartrain and an automatic winder or automatic winding device.

In this second embodiment, elements identical or similar to the elements of the first embodiment bear the same references as those of the elements of the first embodiment. In addition, in this second embodiment, elements having functions identical or similar to those of other elements of the first embodiment bear references which are those of the elements of the first embodiment, with a "'" added.

The movement comprises a second embodiment of the system 10' comprising:

the pawl device 110';

the clutch device 120'; and the coupling device 130' coupling the pawl device and the clutch device.

In this second embodiment, the spring 5*a*' acts on the rocker lever 3 via a pawl 5' which adopts the form of a lever 5*c*'. The lever 5*c*' is one arm of the pawl device 110'. A portion 71' of the arm collaborates by contact with a portion 72' of the clutch device, notably a rocker lever portion of the clutch device or a rocker lever side of the clutch device. The portion 71' is, for example, one end of the arm. The principle of operation of such a device is similar to that of the first embodiment. FIG. 7 illustrates this second embodiment at rest, in a configuration similar to that of FIG. 1. In this rest position, the lever 5*c*' is in contact with a banking 4*a* provided on the frame of the movement, notably on the barrel bridge. Alternatively, the lever 5*c*' could butt against the rocker lever 3, notably via the portions 71' and 72'. In such a case, the rest position is defined by contact between the lever and the rocker lever.

Thus, in this second embodiment, the coupling device 130' comprises a portion 71' of the pawl device and a portion 72' of the clutch device.

For preference, the other elements of the second embodiment are identical or similar to the elements of the first embodiment which were described above.

Whatever the embodiment, the system does not require an additional spring which would add to the one needed for the operation of the pawl device, notably to the pawl spring 5*a* or 5*a*'. Whatever the embodiment, the construction is therefore particularly compact because it uses a preexisting device to generate an additional disengagement function. Moreover, an additional spring would carry the risk of impairing the efficiency of the automatic winding drivetrain because of an additional resistive torque, notably if that spring took the form of a friction foil arranged on the disengagement rocker lever or the form of clips designed to act on the pivoting of the intermediate wheel 2. The solution is therefore particularly advantageous in terms of construction and performance.

In the two embodiments described, the first part of the automatic winding drivetrain is very limited: it comprises only the mainspring 7 and the barrel ratchet 6. Thus, the clutch device collaborates directly or meshes with the ratchet 6. However, it is entirely conceivable to provide one or more intermediate wheels between the input of the first part of the automatic winding drivetrain and the ratchet. An intermediate barrel could for example be interposed between the input of the first part of the automatic winding drivetrain and the ratchet. It is also possible to envision coiling the mainspring directly using the barrel drum (the ratchet being used to transmit energy to the geartrain of the movement, particularly in the case of a movement having at least two barrels).

Likewise, in the two embodiments described, the pawl device collaborates directly with the toothset of the barrel ratchet 6. However, it is entirely conceivable to plan for the pawl device to collaborate directly with any one-way rotating wheel of the winding drivetrain, particularly with any wheel of the first part of the automatic winding drivetrain or alternatively with any one-way rotating wheel of the manual winding drivetrain.

What is meant here by "pawl" is a component or an assembly designed to keep the mainspring under tension. The pawl may, as in the embodiments described, be an assembly of several components, particularly a lever with a beak indexing the toothset of a wheel of the first part of the winding drivetrain under the action of a spring. Alternatively, the pawl may be a leaf spring provided with one or more teeth indexing the toothset of a wheel of the first part of the winding drivetrain.

Advantageously, whatever the embodiment of the movement the pawl device is designed so that it can be actuated while the automatic winding device is assembled on the rest of the movement.

One way of executing a method of operation of a system described hereinabove is explained hereinafter.

Figure 7:
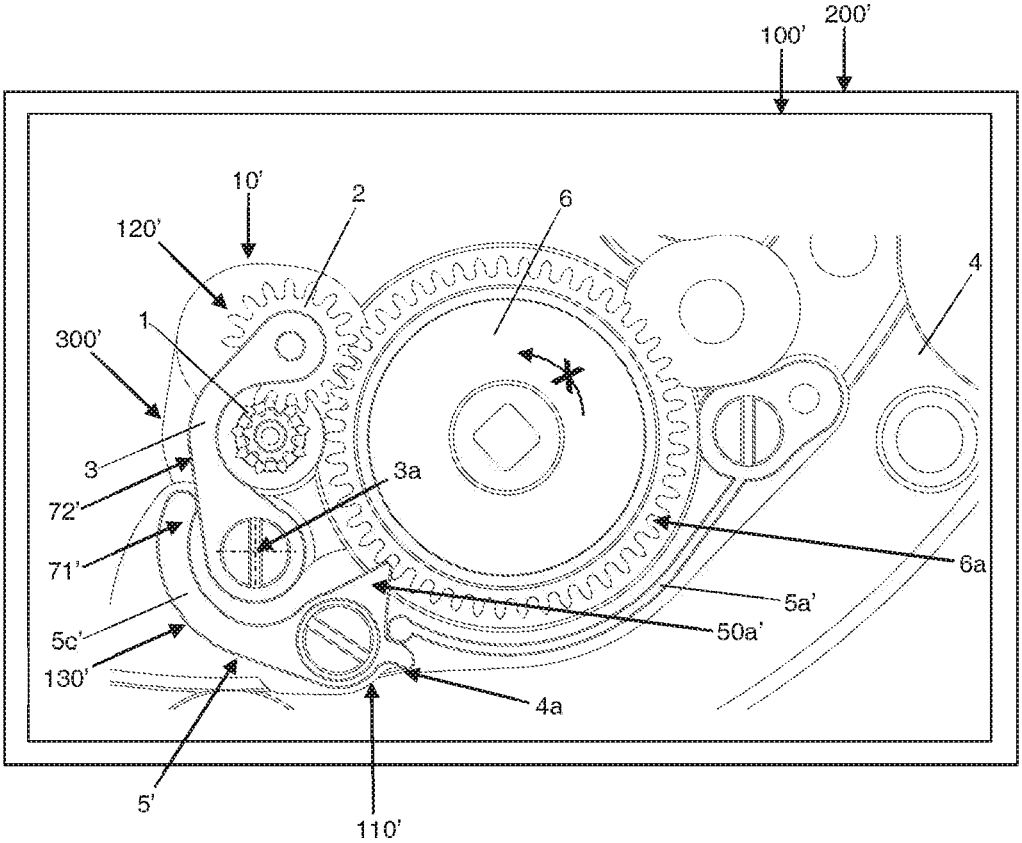
FIG. 7 is a schematic view of a second embodiment of a timepiece according to the invention comprising a second embodiment of the system.

FIGS. 1 and 7 illustrate the system at rest. In this configuration, the beak or the tooth 50*a* of the pawl 5 or the beak or the tooth 50*a*' of the pawl 5', particularly of the lever 5'*c*, is in mesh with the toothset 6*a* of the wheel 6. The lever is therefore capable, in collaboration with the banking 4*a* of the barrel bridge 4 of restraining the wheel 6 which tends to turn in a predefined direction under the effect of the torque produced by the mainspring. In this configuration, the spring 5*a* has no effect on the pawl. Alternatively, the spring 5*a* may act on the pawl. The toothset 2*a* of the intermediate wheel 2 is in mesh respectively with:

the toothset 1*a* of the pinion 1 which constitutes the output of the second part of the automatic winding drivetrain, and the toothset 6*a* of the wheel 6.

For this, the rocker lever 3 is positioned under the effect of the spring 5*a* or of the lever 5*c*' which is in contact with a rocker lever portion.

During manual winding, the method of operation comprises the following steps:

retraction of the pawl 5, 5' under the effect of the rotation of the first wheel 6, release of the clutch device 120, 120' under the effect of the coupling device 130, 130', and disengagement of the clutch device 120, 120' under the effect of the rotation of the first wheel 6.

During the manual winding of the watch as illustrated in FIG. 4, the first wheel is driven in the clockwise direction by a manual winding drivetrain not depicted. The rotation of the first wheel 6 in the clockwise direction causes on the one hand the beak 50*a*, 50*a*' of the pawl 5; 5' to disengage from the toothset 6*a*, and on the other hand the toothset 2*a* of the intermediate wheel 2 to disengage from the toothset 6*a*. Effectively, in this configuration, the spring 5*a* or the lever 5*c*' moves away from the rocker lever 3 under the effect of the toothset 6*a* on the beak 50*a*, 50*a*' of the pawl device. This allows the rocker lever 3 to pivot in the anticlockwise direction about the spindle 3*a* under the effect of a resultant force R of the forces of the first wheel 6 applied to the intermediate wheel 2. The clutch device therefore moves into the disengaged state. The first part of the winding drivetrain is thus disconnected from the second part of the winding drivetrain.

It should be emphasized that in the manual winding configuration, the rocker lever 3 cannot be returned by the spring 5*a* or by the lever 5*c*'. Thus, the rocker lever 3 cannot "oscillate" between its positions depicted in FIGS. 1 and 4 and the toothsets 2*a* and 6*a* cannot come into contact during manual winding. This avoids any risk of premature wearing of these toothsets.

During automatic winding, the method of operation comprises the following steps:

retraction of the pawl 5, 5' under the effect of the rotation of the first wheel 6, release of the clutch device 120, 120' under the effect of the coupling device 130, 130', and engagement of the clutch device 120, 120' under the effect of the rotation of the second wheel.

During automatic winding as depicted in FIG. 5, the first wheel 6 is driven in the clockwise direction by the second part of the winding drivetrain, notably under the effect of the pinion 1 and of the intermediate wheel 2 which respectively rotate in the clockwise and anticlockwise directions. The toothset 2*a* is in mesh with the toothset 6*a*. This meshing is made a lasting one by the orientation of the resultant R' of the forces applied to the intermediate wheel 2. A small amount of friction of the intermediate wheel 2 on the rocker lever may also be provided. Thus, even when the spring 5*a* or the lever 5*c*' moves away from the rocker lever 3 under the effect of the toothset 6*a* on the pawl device, notably after an initial rotation of the first wheel causing the pawl device to move into the deactivated state, the meshing of the toothsets 2*a* and 6*a* is established and maintained.

Once again, in the absence of winding (automatic or manual), which means to say after winding has stopped, the coupling device 130, 130' acts on the clutch device 120; 120' to return the clutch device 120, 120' into the engaged state corresponding to the activated state of the pawl device 110, 110'. The clutch device returns to its engaged state depicted in FIG. 1 under the effect of the restitution of the spring 5*a* or 5*a'*.

In order to uncoil the mainspring, all the watchmaker needs to do is wind the mainspring slightly using the manual winding mechanism. This action deactivates the pawl device and causes the clutch device to move into the disengaged state. The watchmaker then needs to keep the pawl device in the deactivated state while at the same time ceasing to wind the mainspring for long enough for the mainspring to uncoil. The watchmaker therefore has only limited actions to perform on the movement in order to allow the mainspring to uncoil.

In order to do this, with the movement assembled, the pawl 5, 5' preferably remains accessible to the watchmaker as depicted in FIG. 9. This access can be made possible in some positions of the oscillating mass, particularly in the oscillating-mass position depicted in FIG. 9. Thus, the solution offers the watchmaker the option of uncoiling the mainspring even while the automatic winding module is still in place on the barrel bridge 4.

For preference, whatever the embodiment or alternative form of embodiment, in the first position of the rocker lever defining an engaged state of the clutch device, the clutch device, particularly the rocker lever, is in contact with a banking 4*b*.

The system described hereinabove has the particular feature of allowing the automatic winding drivetrain to be disengaged while the pawl is being retracted by the watchmaker so that the mainspring can be uncoiled with a minimum of operation, even though the automatic winding device is still in place on the horology movement. The disengagement device also has the specific feature of being activated when the manual winding device is actuated, so that the automatic winding device is not stressed during the manual winding. Such an embodiment is thus particularly advantageous in the context of a horology movement provided with a two-directional automatic winding device employing clutch wheels or "reversing" wheels the rotational speeds of which are optimized. Of course, such an embodiment can also be implemented within a horology movement provided with some other type of automatic winder, such as the Pellaton type automatic winder. The horology movement is preferably mechanical. It may also be electromechanical.

The system described hereinabove is also particularly advantageous in view of its simplicity and compactness.

In this whole document, the term «pawl» or «click» preferentially means a mechanism for stopping a part (usually a wheel or a ratchet) in a first direction only and for allowing it to rotate in a second direction (opposite to the first direction). In a watch, the pawl prevents the ratchet-wheel from turning backwards when the winding-action stops. The pawl may be a lever provided with a beak which engages in the teeth of a wheel, under the action of a spring.

In this whole document, the term «activated pawl» preferentially means that the pawl stops the part in the first direction only and allows it to rotate in the second direction.

In this whole document, the term «deactivated pawl» or «unclicked pawl» preferentially means that the pawl allows the part to rotate in both first direction and second direction.

The invention claimed is:

1. A system, comprising:

a pawl device for a first wheel of a first part of a drivetrain for winding a mainspring;

a clutch device for engaging a second part of a drivetrain for winding the mainspring with the first part of the drivetrain for winding the mainspring; and a coupling device for coupling the pawl device and the clutch device, and wherein the coupling device is configured a) to keep the clutch device in the engaged state when the pawl device is activated and b) to allow the clutch device an engaged state and, alternatively, a disengaged state when the pawl device is deactivated.

2. The system according to claim 1, wherein the pawl device comprises a pawl equipped with at least one tooth and a return spring for returning the pawl to a rest position corresponding to the activated state of the pawl device in which position the at least one tooth interferes with a toothset of the first wheel.

3. The system according to claim 2, wherein, in the rest position, the pawl is in contact with a banking.

4. The system according to claim 1, wherein the clutch device is a horizontal clutch device and/or a clutch device comprising a rocker lever equipped with an intermediate wheel configured to:

mesh simultaneously with the first wheel and with the second wheel in a first position of the rocker lever defining an engaged state of the clutch device; and not mesh with the first wheel and/or mesh only with the second wheel in a second position of the rocker lever defining a disengaged state of the clutch device.

5. The system according to claim 1, wherein the first wheel is a ratchet.

6. The system according to claim 1, wherein the coupling device comprises a pawl device return spring portion collaborating by contact with a portion of the clutch device.

7. The system according to claim 1, wherein the coupling device comprises an arm of the pawl device, a portion of the arm collaborating by contact with a portion of the clutch device.

8. An automatic watch movement comprising a system according to claim 1.

9. An automatic watch movement according to claim 8, comprising an automatic winding device equipped with reversing wheels.

10. An automatic watch movement according to claim 8, in which the pawl device can be actuated by the watchmaker, whereas the automatic winding module is assembled on the movement.

11. A method of operation of a system according to claim 1, the method comprising, during manual winding:

retracting the pawl under the effect of the rotation of the first wheel, releasing the clutch device under the effect of the coupling device, and disengaging the clutch device under the effect of the rotation of the first wheel.

12. A method of operation according claim 11, the method further comprising, during automatic winding:

retracting the pawl under the effect of the rotation of the first wheel, releasing the clutch device under the effect of the coupling device, and engaging the clutch device under the effect of the rotation of a second wheel of the second drivetrain part for winding the mainspring.

13. A method of operation according to claim 11, the method further comprising:

in the absence of winding, actuating the coupling device on the clutch device so as to return the clutch device to an engaged state.

14. A method of operation according to claim 13, wherein the engaged state corresponds to the activated state of the pawl device.

15. A winding drivetrain for a mainspring according to the system of claim 1, further including:

the second part of the drivetrain comprising reversing wheels, and a horizontal clutch device for connecting the first part of the drivetrain and the second part of the drivetrain.

16. An automatic watch movement comprising a winding drivetrain according to claim 15.

17. An automatic watch movement according to claim 16, wherein the movement comprises a pawl device, the pawl device being arranged so as to be able to be actuated while the automatic winding device is assembled on the rest of the movement.

18. A timepiece, comprising a system according to claim 1.

19. The system according to claim 1, wherein the coupling device is a device for coupling the states of operation of the pawl device and of the clutch device.

20. The system according to claim 1, wherein the coupling device is configured to maintain an engaged state of the clutch device when the pawl device is activated and to allow an engaged state and a disengaged state of the clutch device when the pawl device is deactivated.

21. The system according to claim 20, wherein the coupling device is configured such that when the pawl device is deactivated, the coupling device does not force the clutch device to be in the engaged state or in the disengaged state.

22. The system according to claim 21, wherein the coupling device is configured such that the state of the clutch device is dictated by states of the first and second parts of the automatic winding drivetrain.

23. The system according to claim 22, wherein the coupling device is configured such that driving of the first part of the automatic winding drivetrain due to manual winding without driving of the second part of the automatic drivetrain causes disengagement of the clutch device and such that driving of the second part of the automatic winding drivetrain due to movement of an oscillating mass causes engagement of the clutch device.

* * * * *